US006437274B2

(12) United States Patent
Claessens et al.

(10) Patent No.: US 6,437,274 B2
(45) Date of Patent: Aug. 20, 2002

(54) HYBRID CIRCUIT BREAKER

(75) Inventors: Max Claessens, Baden-Rütihof; Klaus-Dieter Weltmann, Baden-Dättwil; Leopold Ritzer, Untersiggenthal; Ekkehard Schade, Baden-Dättwil, all of (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 09/729,271

(22) Filed: Dec. 5, 2000

(30) Foreign Application Priority Data

Dec. 6, 1999 (DE) ..... 199 58 646

(51) Int. Cl.[7] ..... H01H 9/40
(52) U.S. Cl. ..... 218/3; 218/43; 218/70
(58) Field of Search ..... 218/43, 48, 69, 218/70, 134, 136, 138, 140, 155, 2–7, 14

(56) References Cited

U.S. PATENT DOCUMENTS 4,002,867 A * 1/1977 Cherry ..... 218/155
5,294,761 A * 3/1994 Okutomi et al. ..... 218/155
5,808,258 A * 9/1998 Luzzi ..... 218/136
5,994,850 A * 11/1999 Seddon et al. ..... 218/132

FOREIGN PATENT DOCUMENTS

DE 31 31 271 8/1982
EP 0 847 586 4/1999

* cited by examiner

*Primary Examiner*—Lincoln Donovan
(74) *Attorney, Agent, or Firm*—Burns, Doane, Swecker & Mathis, L.L.P.

(57) ABSTRACT

This hybrid circuit breaker has at least two series-connected arcing chambers which are operated by a common drive or by separate drives and are filled with different arc extinguishing media. Means are provided which ensure a sensible voltage distribution between the first and the second arcing chamber in the course of a switching process. At least one vacuum switching chamber having an insulating housing, is provided as the second arcing chamber. The aim is to provide a hybrid circuit breaker wich can be produced economically and which has high availability. This is achieved, inter alia, in that means are provided which ensure that the movement of the contacting arrangement of the first arcing chamber precedes the movement of the contact arrangement of the second arcing chamber during a disconnection process, and that the movement of the contacting arrangement of the second arcing chamber precedes the movement of the contact arrangement of the first arcing chamber during a connection process. The second arcing chamber is permanently bridged by a non-reactive resistor, which is in the form of a resistance coating applied to the inner wall or the outer wall of the insulating housing of the second arcing chamber.

14 Claims, 3 Drawing Sheets

HYBRID CIRCUIT BREAKER

This application claims priority under 35 U.S.C. §§119 and/or 365 to Appln. No. 199 58 646.2 filed in Germany on Dec. 6, 1999; the entire content of which is hereby incorporated by reference.

FIELD OF THE INVENTION

The invention relates to a hybrid circuit breaker.

BACKGROUND OF THE INVENTION

The document EP 0 847 586 B1 discloses a hybrid circuit breaker which can be used in an electrical high-voltage network. This hybrid circuit breaker has two series-connected arcing chambers, a first of which is filled with $SF_6$ gas as an arc extinguishing and insulating medium, and a second of which is in the form of a vacuum switching chamber. The second arcing chamber is surrounded by $SF_6$ gas on the outside. The main contacts in the two arcing chambers are operated simultaneously via a lever transmission from a common drive. Both arcing chambers have a power current path, in which the consumable main contacts are located, and a rated current path in parallel with it, with this rated current path having only a single interruption point. On disconnection, the rated current path is always interrupted first, after which the current to be disconnected commutates onto the power current path. The power current path then continues to carry the current until it is definitively disconnected.

In this hybrid circuit breaker, the arc which always occurs in the vacuum switching chamber during disconnection burns for approximately the same time period as in the gas-filled first arcing chamber, which means that the main contacts in the vacuum switching chamber are subjected to a comparatively high and long-lasting current load and, linked to this, a high wear rate, which means that maintenance work has to be carried out comparatively frequently, as a result of which the availability of the hybrid circuit breaker is limited. This hybrid circuit breaker requires a comparatively large amount of drive energy since, depending on the switching principle used in the gas-filled first arcing chamber, the drive has to produce all or part of the high gas pressure required for intensively blowing out the arc. Such a drive, which is designed to be particularly powerful, is comparatively expensive.

After the arc has been extinguished, the returning voltage that occurs across this hybrid circuit breaker is distributed between the two arcing chambers in a corresponding manner to the intrinsic capacitances of these arcing chambers. This means that the second arcing chamber, which is in the form of a vacuum switching chamber, has the majority of the returning voltage applied to it, so that this second arcing chamber strikes while the returning voltage is rising. This striking can occur a number of times during a disconnection process. The striking can initiate undesirable oscillation processes in the high-voltage network, linked to undesirable voltage rises. Furthermore, the striking process additionally stresses the consumable contacts in the vacuum switching chamber, so that their life is shortened.

Laid-open specification DE 3 131 271 A1 discloses a hybrid circuit breaker, in which the voltage distribution across the two switching chambers is attainable by means of a capacitance which is connected in parallel with the first switching chamber, which is insulated and blown by a gas, and by means of a nonlinear resistance connected in parallel with the second switching chamber, which is in the form of a vacuum switching chamber. During the rise of the returning voltage immediately after the interruption of the arc, these two components ensure that the majority of this returning voltage is first of all applied to the vacuum switching chamber, which withstands it. Subsequently, the first switching chamber then takes over the majority of the applied voltage. These two components for controlling the voltage distribution require a comparatively large volume in the interior of the switch housing of the hybrid circuit breaker, so that the circuit breaker requires a comparatively large, and therefore also expensive, switch housing.

SUMMARY OF THE INVENTION

The invention achieves the object of providing a hybrid circuit breaker which can be produced economically and which has a high availability.

In this hybrid circuit breaker the first, steep rise in the returning voltage is borne essentially by the second arcing chamber, which is in the form of a vacuum switching chamber. Accordingly, the dielectric recovery of the extinguishing path in the first arcing chamber may take place comparatively slowly, which means that the blowing in the first arcing chamber may be considerably less intensive than in conventional circuit breakers. Considerably less energy thus needs to be consumed to provide the pressurized gas required for blowing out the arc.

The advantages achieved by the invention are that the hybrid circuit breaker can be equipped with a considerably weaker and thus more economic drive for the same power switching capacity. Furthermore, the pressures which occur in the first arcing chamber in this hybrid circuit breaker are considerably lower than in conventional circuit breakers, so that the insulating tube and the other parts that are subjected to pressure can be designed for reduced loads as well, thus making it possible to design the hybrid circuit breaker to be more economic. Furthermore, it is advantageous that the flow rate of the gas which cools the arc in the first arcing chamber may be in the subsonic range since the blowing required in this case is considerably less intensive and, in consequence, the amount of pressurized gas that needs to be provided for blowing can be kept comparatively small. A further advantage is that the consumable contacts in the second arcing chamber which, in this case, is in the form of a vacuum switching chamber have a longer life owing to the shorter duration of the current load during disconnection and owing to the avoidance of the repeated striking process while the returning voltage is rising, and this results in advantageously improved operational availability of the hybrid circuit breaker.

The hybrid circuit breaker is provided with at least two series-connected arcing chambers which are operated by a common drive or by separate drives and are filled with different arc extinguishing media, wherein the arc extinguishing and insulating medium in the first arcing chamber surrounds the second arcing chamber in an insulating manner. Means are provided which ensure a technically sensible voltage distribution between the two arcing chambers during the disconnection process. Furthermore, means are provided which ensure that the movement of the first arcing chamber leads the movement of the second arcing chamber during the disconnection process. During the connection process, the second arcing chamber always closes before the first arcing chamber. A gas or a gas mixture is used as the arc extinguishing and insulating medium in the first arcing chamber. At least one vacuum switching chamber is provided as the second arcing chamber. However, other switching principles may also be used for the second arcing chamber.

BRIEF DESCRIPTION OF THE DRAWINGS

The invention, its development and the advantages which can be achieved by it are explained in more detail in the following text with reference to the drawing, which illustrates only one possible embodiment.

In the figures.

In all the figures, elements having the same effect are provided with the same reference symbols. Only those elements which are required for direct understanding of the invention are illustrated and described.

DESCRIPTION OF THE INVENTION

Figure 1:
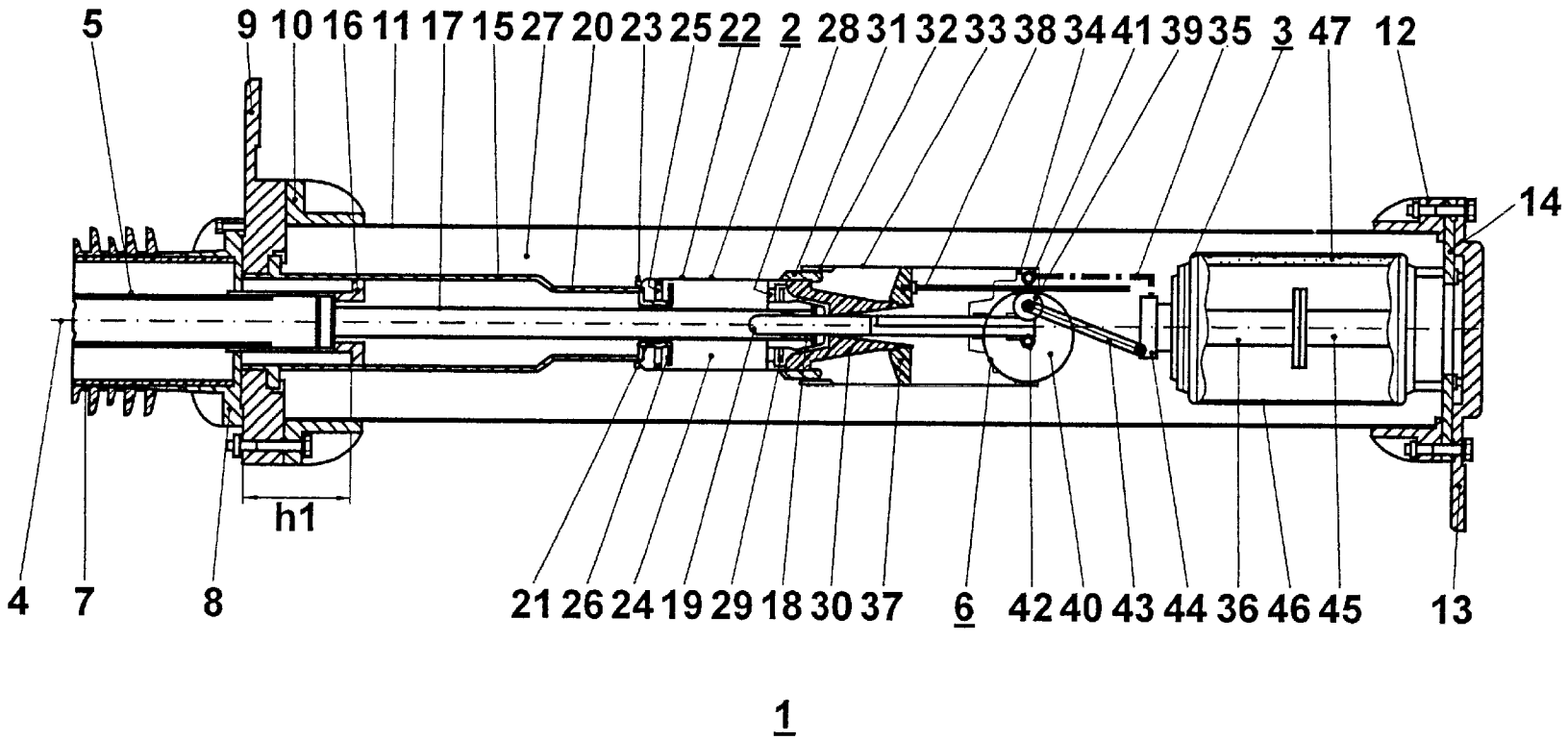
FIG. 1 shows an embodiment of a hybrid circuit breaker, illustrated in highly simplified form, in the connected state, in which the arc in the first arcing chamber is blown out by gas which is compressed in a piston-cylinder arrangement.

FIG. 1 shows a first embodiment of a hybrid circuit breaker 1, illustrated in highly simplified form, in the connected state. This hybrid circuit breaker 1 has two series-connected arcing chambers 2 and 3 which in this case are mounted such that they extend along a common longitudinal axis 4 and are arranged concentrically with respect to this axis. It is entirely possible in other embodiments of this hybrid circuit breaker 1 to arrange the arcing chambers 2 and 3 on different longitudinal axes, angled with respect to one another. It is even feasible in the variant with angled longitudinal axes for these longitudinal axes not only to lie in a plane or in two planes arranged parallel to one another, but also for these planes to intersect at an angle which is useful for design purposes.

The hybrid circuit breaker 1 is driven by a drive (not illustrated) via a drive rod 5 which is composed of electrically insulating material. A conventional energy storage drive may be provided as the drive. However, it is also possible to use an electronically controllable DC drive without the interposition of any energy store. This design variant may be regarded as being particularly economic and, furthermore, it allows the contact movement speeds of the hybrid circuit breaker 1 to be matched to the respective particular operational requirements using simple means. A gearbox 6 is arranged between the two arcing chambers 2 and 3, links the movements of the two arcing chambers 2 and 3 to one another and matches the movement sequences to one another in a technically sensible manner.

The drive rod 5 is protected against environmental influences by a supporting insulator 7 to which the arcing chambers 2 and 3 of the hybrid circuit breaker 1 are fitted. The supporting insulator 7 is connected in a pressuretight manner on the electrical ground side to the drive (which is not illustrated), and on the arcing chamber side it is provided with a metallic flange 8 which is screwed to a first metallic connection flange 9. The drive side of the arcing chamber 2 is connected to the electrical power supply system via the connecting flange 9. Furthermore, a first end flange 12 of an arcing chamber housing 11 is screwed to the connecting flange 9. The arcing chamber housing 11 is cylindrical, pressuretight and electrically insulating, extends along the longitudinal axis 4 and surrounds the two arcing chambers 2 and 3 and the gearbox 6. On the side opposite the first end flange 10, the arcing chamber housing 11 has a second metallic end flange 12, which is screwed to a second metallic connecting flange 13. The side of the arcing chamber 3 facing away from the drive is connected via the connecting flange 13 to the electrical power supply system. A metallic mounting plate 14 is held between the end flange 12 and the connecting flange 13.

The connecting flange 9 is rigidly and electrically conductively connected to the cylindrical metallic mounting tube 15, which is arranged concentrically with respect to the longitudinal axis 4. The mounting tube 15 has openings (which are not illustrated) which are used to exchange gas between the interior of the mounting tube 15 and the rest of the arcing chamber volume. The inner part of the mounting tube 15 on the drive side is used as a guide for a guide part 16, which is connected to the drive rod 5 and supports said drive rod 5 against the mounting tube 15. The guide part 16 is designed such that it limits the travel h1 of the drive rod 5 when the hybrid circuit breaker 1 is in the disconnected position.

At the end, the drive rod 5 is connected to a metallic contact tube 17, which represents a first moving power contact in the first arcing chamber 2. The shaft of the contact tube 17 has openings (which are not illustrated) which are used for exchanging gas between the interior of the contact tube 17 and the interior of the mounting tube 15. On the side facing away from the drive, the contact tube 17 is provided with sprung consumable fingers 18, which are arranged in a tulip shape. The consumable fingers 18 enclose and make contact with a metallic consumable pin 19. The consumable pin 19 extends axially in the center of the arcing chamber 2, and is arranged such that it can move axially. The consumable pin 19 always moves in the opposite direction to the movement direction of the contact tube 17. The consumable pin 19 represents the second moving power contact in the first arcing chamber 2.

On the side facing away from the drive, the supporting tube 15 has a narrowed region 20 and a guide element 21 which guides the contact tube 17. The guide element 21 is provided internally with spiral contacts (which are not illustrated) which allow current be transferred properly from the mounting tube 15 to the contact tube 17. A metallic nozzle holder 22 slides on the outside of the narrowed region 20 and is equipped on the drive side with sliding contacts 23 which allow the current to be transferred properly from the mounting tube 15 to the nozzle holder 22.

The nozzle holder 22 encloses a compression volume 24. On the drive side, the compression volume 24 is closed off by a non-return valve 25, which is held by the guide element 21. The non-return valve 25 has a valve disk 26 which prevents compressed gas from emerging into the arcing chamber volume 27, which is common to both arcing chambers 2 and 3, when the pressure in the compression volume 24 is raised. A further non-return valve 28, which is held in the nozzle holder 22, is provided on the opposite side of the cylindrical compression volume 24, and its valve disk 29 allows compressed gas to emerge from this compression volume 24 when the pressure in the compression volume 24 is raised.

An insulating nozzle 30 is held in the nozzle holder 22, on the side facing away from the drive. The insulating nozzle 30 is arranged concentrically around the consumable pin 19. The contact tube 17, the nozzle holder 22 and the insulating nozzle 30 form an integral assembly. The nozzle constriction is arranged immediately in front of the consumable fingers 18, and the insulating nozzle 30 opens in the opposite direction to the consumable fingers 18. On the outside, the nozzle holder 22 has a thickened region 31 which is designed as a contact point. When the arcing chamber 2 is in the connected state, sliding contacts 32 rest on this thickened region 31. These sliding contacts 32 are connected to a cylindrical metallic housing 33, which is held by a metallic guide part 34 mounted in a fixed position. Sliding contacts (which are not illustrated) are provided in a central hole in the guide part 34 and connect the guide part 34 to the consumable pin 19 in an electrically conductive manner. As indicated by a line of action 35, the current path passes from the guide part 34 via a connecting part 44 on to the moving contact 36 in the second arcing chamber 3.

An electrically insulating holding disk 37 is mounted rigidly on the insulating nozzle 30, on its side facing away from the drive. The holding disk 37 may, however, also be composed of a metal provided the dielectric conditions in this region allow. A toothed rod 38 is screwed into this holding disk 37, extends parallel to the longitudinal axis 4, and operates the gearbox 6. The toothed rod 38 engages with two gearwheels 39 and 40, and is pressed against these gearwheels 39 and 40 by a supporting roller 41. A groove which is provided with teeth is incorporated in the shaft of the consumable pin 19, which is guided by the guide part 34, and the gearwheel 39 engages in this groove. A further supporting roller 42 presses the shaft of the consumable pin 19 against the gearwheel 39. The gearwheel 40 operates the second arcing chamber 3 via a lever 43 which is coupled to it such that it can move. The lever 43 is coupled to the connecting part 44, which is electrically conductively connected to the moving contact 36 in the second arcing chamber 3.

Here, the second arcing chamber 3 is illustrated schematically as a vacuum switching chamber. For example, it is also possible for the switching point in this arcing chamber 3 to operate on the basis of other switching principles. The arcing chamber 3 is surrounded by the insulating medium which fills the common arcing chamber volume 27. The arcing chamber 3 has a stationary contact 45 which is electrically conductively connected to the mounting plate 14. The mounting plate 14 is used to fix the arcing chamber 3. The arcing chamber 3 has an insulating housing 46 which separates the interior of the arcing chamber 3 from the arcing chamber volume 27 in a pressuretight manner. The insulating housing 46 is illustrated partially cut open here.

The wall of the insulating housing 46 is provided with a resistance coating 47. This resistance coating 47, which is intended to satisfy the necessity to control the distribution of the returning voltage between the two arcing chambers 2 and 3 during disconnection, may be applied to the inner or to the outer surface of the insulating housing 46. This propitious, highly space-saving configuration of the resistance coating 47 advantageously allows the dimensions of the second arcing chamber 3 to be kept small. The electrical resistance of the resistance coating 47 is in the range between 10 kΩ and 500 kΩ, and it has been found to be particularly advantageous for the resistance value to be 100 kΩ.

Figure 3:
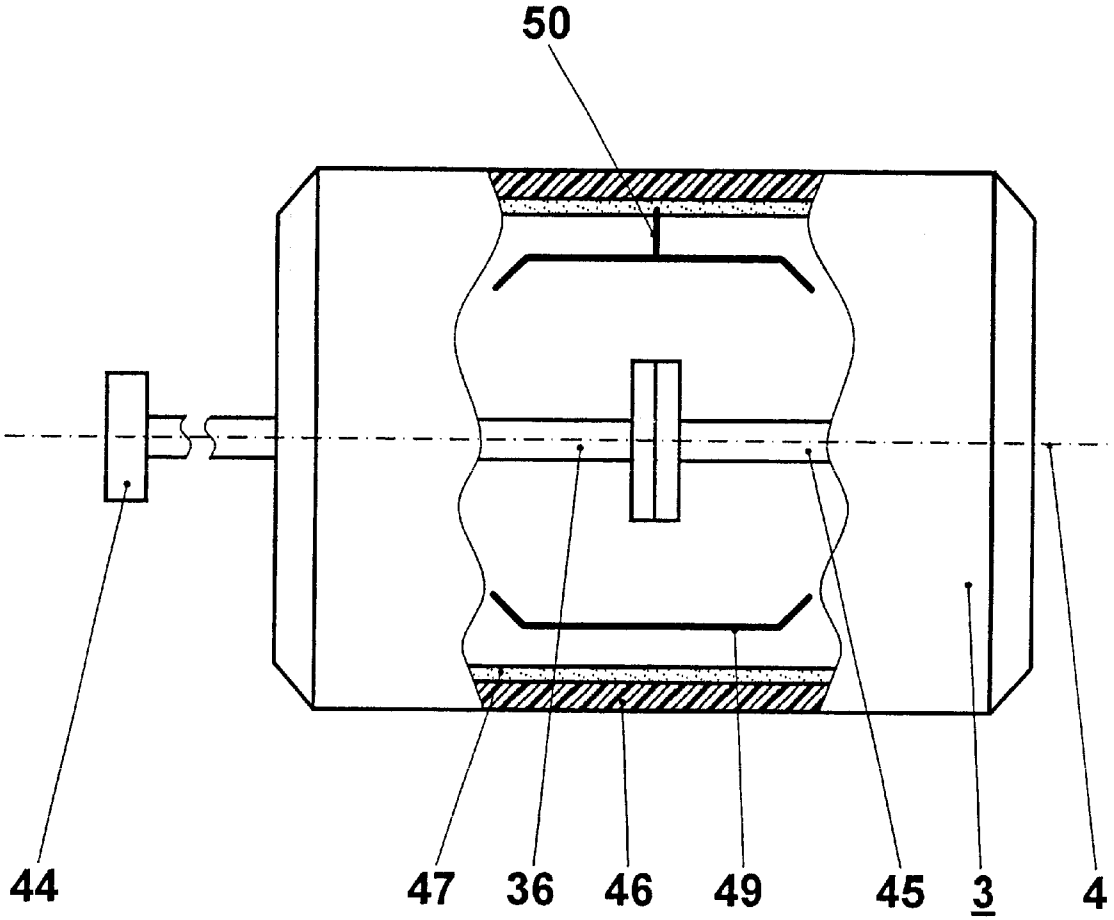
FIG. 3 shows a highly simplified section through one embodiment of the vacuum switching chamber used in the hybrid circuit breaker.

FIG. 3 shows a highly simplified illustration of one embodiment of the second arcing chamber 3, which in this case is in the form of a vacuum switching chamber. This vacuum switching chamber is provided with a cylindrical, electrically conductive shield 49, which keeps switching residues away from the insulating housing 46 and away from the resistance coating 47. The shield 49 is connected by means of an electrically conductive link 50 to the center of the resistance coating 47, in terms of potential, which is defined to be at this potential during the disconnection process. Contact is made between the link 50 and the resistance coating 47 by means of a conductive lacquer applied to the resistance coating 47. However, other embodiment variants without this link 50 are also feasible. The resistance coating 47 may be applied in the form of strips to the inner or outer surface of the insulating housing 46, but it may also be coated with the resistance coating 47 over its entire surface.

In this case, the resistance coating 47 has a matrix composed of epoxy resin in which carbon black or spherical glass particles are incorporated, distributed uniformly. The carbon black is used as an electrical conductor, and the resistance value of the resistance coating 47 is set by the amount of the added carbon black. The spherical glass particles are used as a filler and their task is to match the coefficient of expansion of the resistance coating 47 to that of the insulating housing 46 in order to prevent the resistance coating 47 from becoming detached from the insulating housing 46 when thermal expansion occurs. The resistance coating 47 can be prefabricated and can then be bonded into the insulating housing 46, or bonded onto it externally, or, alternatively, it can be applied as a paste to the respective surface of the insulating housing 46 and can then be cured, in which case it adheres very well to the material of the insulating housing 46. The insulating housing 46 used here is manufactured from a ceramic material, but other insulating materials are also feasible. During the curing process, the insulating housing 46 is then also heated.

The casting resin used for the matrix of the resistance coating 47 may originate from one of the groups of anhydride-cured epoxy resins, unsaturated polyester resins, acryl resins and polyurethane resins. However, it is also possible to use an electrically conductive silicone resin with an appropriately adjusted conductivity as the resistance coating 47. The spherical glass particles used as a filler have a diameter of from 1 μm to 50 μm, with a good average distribution in the region between 10 μm and 30 μm. Spherical glass particles are advantageously used which are already coated with an adhesion promoter, since the connection between the casting resin matrix and the spherical glass particles is then particularly intimate, resulting in a highly homogeneous resistance coating 47. Other mineral or inorganic fillers may be used in conjunction with the spherical glass particles, or even without them.

The common arcing chamber volume 27 is filled with an electrically negative gas or gas mixture which has an electrically insulating effect and is used not only as an arc extinguishing medium for the first arcing chamber 2, but also as an insulating medium. The filling pressure in this case is in the range from 3 bar to 22 bar, and a filling pressure of 9 bar is preferably provided. Pure $SF_6$ gas or a mixture of $N_2$ gas and $SF_6$ gas is used as the arc extinguishing and insulating medium. However, it is also possible to use a mixture composed of compressed air and $N_2$ gas, and other electrically negative gases, in this case. Gas mixtures with a proportion of from 5% to 50% of $SF_6$ gas have been proven in particular.

In the connected state, the hybrid circuit breaker 1 carries the current via the following current path, which is referred to as the rated current path: connecting flange 9, mounting tube 15, nozzle holder 22, housing 33, guide part 34, line of action 35, connecting part 44, moving contact 36, stationary contact 45, mounting plate 14 and connecting flange 13. However, particularly if the hybrid circuit breaker 1 has to be designed for comparatively high rated currents, it is also possible to provide a separate rated current path, which is suitable for high rated currents, in parallel with the second arcing chamber 3.

When the hybrid circuit breaker 1 receives a disconnection command, then the drive (which is not illustrated) moves the contact tube 17 and, with it, the insulating nozzle 30 to the left. At the same time as this movement, the consumable pin 19 is moved, driven by the toothed rod 38 and via the gearwheel 39, in the opposite direction to the right, while the housing 33 and the guide part 34 remain in fixed positions. As soon as the thickened region 31 of the nozzle holder 22 has been disconnected from the sliding contacts 32 of the housing 33, the rated current path mentioned above is interrupted and the current to be disconnected now commutates onto the power current path, which is located on the inside. The power current path passes through the following parts of the circuit breaker: connecting flange 9, mounting tube 15, guide element 21, contact tube 17, consumable pin 19, guide part 34, line of action 35, connecting part 44, moving contact 36, stationary contact 45, mounting plate 14 and connecting flange 13.

The contact tube 17 and, with it, the insulating nozzle 30 are moved further to the left once the rated current path has been interrupted, and the consumable pin 19 is moved further in the opposite direction, at the same speed. The contact disconnection in the power current path takes place after this in the course of this movement sequence. This contact disconnection results in an arc being formed between the consumable fingers 18 and the tip of the consumable pin 19 in an arcing space 48 provided for this purpose.

Generally, the second arcing chamber 3 remains closed until this time. It opens only after a time delay $T_v$, which is defined by the following relationship:

$$T_v=(t_{Libo\ min}-t_1)\ \text{ms}.$$

Figure 2:
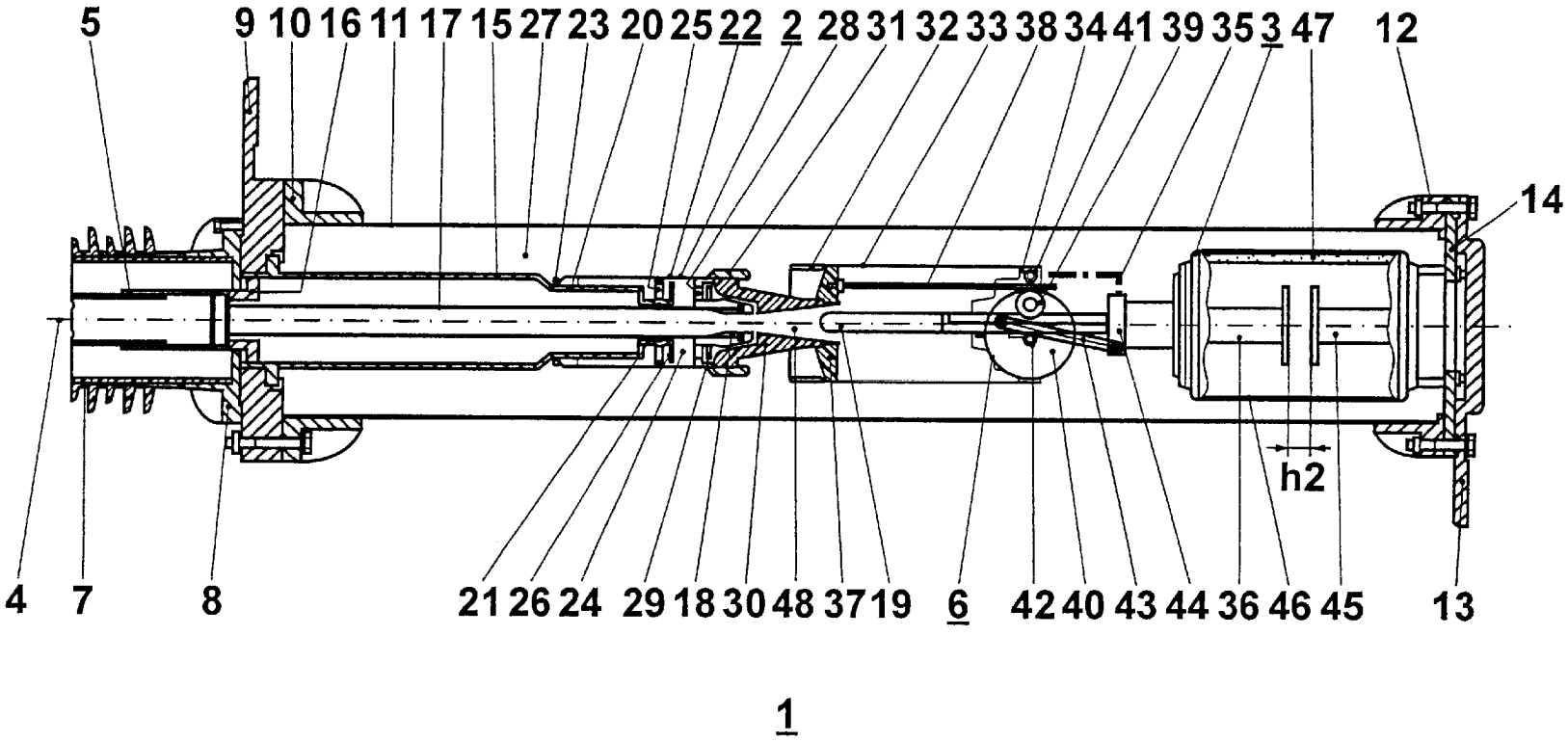
FIG. 2 shows this embodiment of the hybrid circuit breaker, illustrated in highly simplified form, in the disconnected state.

In this case, $t_{Libo\ min}$ is the minimum possible arcing time in ms for the arcing chamber 2 into which gas is being blown, and this arcing time is determined by the power supply system data for the respective location of the hybrid circuit breaker 1 and by the characteristics of the hybrid circuit breaker 1, for example its intrinsic operating time. The time $t_1$, is in the range from 2 ms to 4 ms. This time delay $T_v$ is produced, such that it cannot be circumvented, by the gearbox 6. The second arcing chamber 3 also has a considerably shorter travel h2 than the arcing chamber 2, as can be seen in FIG. 2.

During the disconnection movement of the first arcing chamber 2, the gas or gas mixture located in the compression volume 24 is compressed, but the non-return valve 25 prevents the compressed gas from emerging into the common arcing chamber volume 27 on the side of the compression volume 24 remote from the insulating nozzle 30. A comparatively small amount of compressed gas flows through the non-return valve 28 into the arcing space 48 at this stage, provided the pressure conditions there allow this. The diameter of the constriction in the insulating nozzle 30, the diameter of the consumable pin 19, which is still a considerable proportion of this nozzle constriction at the start of the disconnection movement and also closes the outlet flow cross section through the consumable fingers 18, and the internal diameter of the contact tube 17 are matched to one another such that, while the arc is being blown out, sufficient gas or gas mixture composed of unionized and ionized gas is always carried out from the arcing space 48 so that only a gas pressure which is considerably less than that in conventional circuit breakers can build up there. The magnitude of this gas pressure is fixed such that the outlet flow speed from the arcing space 48 is generally in the range below the speed of sound. As a consequence of these comparatively low pressures in the arcing space 48, the pressure build up in the compression volume 24 can likewise be kept comparatively small, so that only a comparatively small amount of drive energy is required for the compression process. In comparison to conventional circuit breakers, a weaker and thus lower-cost drive can thus advantageously be used here for the hybrid circuit breaker 1, since the gas pressures during disconnection are lower.

Immediately after contact disconnection in the power current path, the consumable pin 19 releases a greater portion of the cross section of the narrowed region of the insulating nozzle 30 than the outlet flow cross section. The process of blowing out the arc which is burning in the arcing space 48 when the disconnection currents are comparatively small actually starts on contact disconnection. The arc extinguishing and insulating medium always flows during this blowing process at a flow rate which is in the range below the speed of sound. When larger currents are being disconnected, as can occur, for example, when disconnecting short circuits in the supply system, the arc heats the arcing space 48 and the gas contained in it so intensively that the pressure in this space is somewhat higher than the pressure in the compression volume 24. In this case, the non-return valve 28 prevents the heated and pressurized gas from flowing into the compression volume 24, and prevents the possibility of it being stored there. Instead of this, the heated and pressurized gas flows away, firstly through the interior of the contact tube 17 and secondly through the insulating nozzle 30, into the common arcing chamber volume 27. In this case, the process of blowing out the arc does not start until the intensity of the arc and thus the pressure in the arcing space 48 have decayed to such an extent that the non-return valve 28 can open, that is to say the pressure in the compression volume 24 is then higher than the pressure in the arcing space 48. In this case, while the arc is being blown out, the arc extinguishing and insulating medium also flows at a flow rate which is in the range below the speed of sound.

In this embodiment of the hybrid circuit breaker 1, the arcing space 48 of the first arcing chamber 2 is designed such that it has a very small dead volume, with the result that it is impossible for any significant amount of pressurized gas produced by the arc itself to be stored, and, as a consequence of this, no significant assistance is given to the process of blowing out the arc by pressurized gas produced by the arc itself either, since this is the only way to make it possible to ensure that the flow rate is in the subsonic range while the arc is being blown out.

Once the arcing chambers 2 and 3 have extinguished the arc, a portion of the returning voltage always occurs between the consumable fingers 18 and the consumable pin 19 in the arcing chamber 2, and between the moving contact 36 and the stationary contact 45 in the arcing chamber 3. The switching path of the vacuum switching chamber always recovers more quickly after an arc has been extinguished than the switching path in a gas circuit breaker, so that the vacuum switching chamber will carry the majority of this voltage at the start of the rapid rise in the returning voltage. The splitting of the returning voltage between two series-connected arcing chambers is normally governed by the intrinsic capacitances of the two arcing chambers. However, the comparatively high resistance of the resistance coating 47 which is arranged in parallel with the second arcing chamber 3 in this case ensures, in a precisely defined manner, that the returning voltage is split between the two arcing chambers 2 and 3 such that, initially, the majority of the returning voltage is applied to the second arcing chamber 3. Only as the disconnection process progresses further does the first arcing chamber 2 then take over the majority of the returning voltage which is then applied to the hybrid circuit breaker 1 overall. When the hybrid circuit breaker 1 is in the disconnected state, the first arcing chamber 2 then bears the majority of the applied voltage. When designing this resistive voltage control process, care must be taken to ensure that no restrikes can occur in the second arcing chamber 3 while the returning voltage is rising.

FIG. 2 shows the hybrid circuit breaker 1 in the disconnected state. When the hybrid circuit breaker 1 is being connected, the second arcing chamber 3 always closes first, to be precise without any current being applied. This timing is ensured by the gearbox 6. Once the second arcing chamber 3 has closed, the two moving contacts of the power current path in the first arcing chamber 2 then move toward one another. When the appropriate prestriking distance is reached, a connection arc is formed, and this closes the circuit. The two moving contacts of the power current path in the arcing chamber 2 move further toward one another until they make contact. The rated current path is not closed until this has been done and, from then on, the current is carried through the arcing camber 2. The two moving contacts of the power current path in the arcing chamber 2 now move somewhat further until, in the end, they have reached the definitive connected position.

It has been found to be particularly advantageous in this hybrid circuit breaker 1 that the second arcing chamber 3 is switched on without any current flowing and that, therefore, it is not subjected to any contact wear during connection or to contacts sticking as a consequence of overheated contact surfaces being welded, either. Providing the operating conditions are normal, the contacts 36 and 45 do not need to be replaced during the life of the hybrid circuit breaker 1, thus advantageously simplifying operational maintenance of the hybrid circuit breaker 1, and advantageously increasing its operational availability.

Apart from the described embodiment, which is provided with a compression volume 24 for producing the pressurized gas required for blowing out the arc, other embodiments may also be used as the first arcing chamber 2, such as: an arcing chamber with a separate storage-volume for storing the part of the gas produced by arc assistance, which interacts with the compression volume, or an arcing chamber with an only partially compressible storage volume for storing the part of the gas produced by arc assistance, or an arcing chamber having an only partially compressible blowing volume, in which the pressurized gas is produced entirely without any arc assistance.

In each of these embodiments of the hybrid circuit breaker 1, the opening of the second arcing chamber 3 during the disconnection process likewise lags the opening of the first arcing chamber 2, and it closes before the first arcing chamber 2 during the connection process, as has already been described. Furthermore, in each of the embodiments described here, the drive forces during disconnection can additionally be assisted by means of a differential piston. This measure makes it possible to reduce the requirement for mechanical drive energy further, and to reduce the price of the drive further, in a simple way.

In the embodiments of the hybrid circuit breaker 1 described above, it has been found to be particularly advantageous that the arc extinguishing pressure required in the arcing chamber 2 is reduced by a factor of 5 to 15 with respect to that in conventional circuit breakers, depending on the $SF_6$ content of the gas filling in the arcing chamber 2. The drive and the other components can therefore be designed for reduced force and pressure loads, which advantageously reduces the price of the hybrid circuit breaker 1.

What is claimed is:

1. A hybrid circuit breaker having at least two series-connected arcing chambers which are operated by a common drive or by separate drives are filled with different arc extinguishing media, where the arc extinguishing and insulating medium in a first arcing chamber surround a second arcing chamber in an insulating manner, where means are provided which ensure a voltage distribution between the first and the second arcing chambers in the course of a switching process in a manner corresponding to the intrinsic capacitance of each of said arcing chambers, and where a pressurized gas or a gas mixture is used as the arc extinguishing medium and insulating medium in the first arcing chamber, while at least one vacuum switching chamber having an insulating housing is provided as the second arcing chamber wherein means are provided which ensure that movement of a contact arrangement of the first arcing chamber precedes movement of a contact arrangement of the second arcing chamber during a disconnection process, and that the movement of the contact arrangement of the second arcing chamber precedes the movement of the contact arrangement of the first arcing chamber during a connection process, wherein the second arcing chamber is permanently bridged by a nonreactive, linear resistor, and wherein the non-reactive resistor is in the form of a resistance coating which is applied to the inner wall or the outer wall of the insulating housing of the second arcing chamber, said resistance coating having a cast resin matrix.

2. The hybrid circuit breaker as claimed in claim 1, wherein the value of the non-reactive resistor is in the range between 10 and 500 kΩ, but is preferably 100 kΩ.

3. The hybrid circuit breaker as claimed in claim 1, wherein the resistance coating is introduced into, or applied externally to, the insulating housing in the form of a paste which can be painted on and has a curable casting-resin matrix.

4. The hybrid circuit breaker as claimed in claim 1, wherein the resistance coating is introduced or applied as a prefabricated part having a cured casting-resin matrix.

5. The hybrid circuit breaker as claimed in claim 1, wherein the coefficient of expansion of the resistance coating is matched to that of the insulating housing by means of spherical glass particles which are used as a filler, where these glass particles have a diameter of from 1 $\mu$m to 50 $\mu$m, and have an average distribution in the region between 10 $\mu$m and 30 $\mu$m.

6. The hybrid circuit breaker as claimed in claim 5, wherein the spherical glass particles are coated with an adhesion promoter.

7. The hybrid circuit breaker as claimed in claim 1, wherein the conductivity of the resistance coating is achieved by adding conductive particles, preferably carbon-black particles.

8. The hybrid circuit breaker as claimed in claim 3, wherein the casting resin used for the matrix of the resistance coating originates from one of the groups of anhydride-cured epoxy resins, unsaturated polyester resins, acryl resins or polyurethane resins.

9. The hybrid circuit breaker as claimed in claim 1, wherein the first arcing chamber has a power current path and a rated current path in parallel with it, and wherein the second arcing chamber has no separate rated current path.

10. The hybrid circuit breaker as claimed in claim 1, wherein both the first and the second arcing chambers have a power current path and a rated current path connected in parallel with it.

11. The hybrid circuit breaker as claimed in claim 1, wherein pure $SF_6$ gas or a mixture composed of $N_2$ gas and $SF_6$ gas, or else a mixture composed of compressed air with other electrically negative gases, is used as the arc-extinguishing and insulating medium.

12. The hybrid circuit breaker as claimed in claim 11, wherein a gas mixture in which the proportion of $SF_6$ gas is from 5% to 50% is preferably used.

13. The hybrid circuit breaker as claimed in claim 1, wherein the filling pressure of the first arcing chamber is in the range from 3 bar to 22 bar, but is preferably around 9 bar.

14. The hybrid circuit breaker as claimed in claim 1, wherein the time lead $T_v$ of the movement of the first arcing chamber with respect to the second arcing chamber during disconnection is defined by the following relationship:

$$T_v=(t_{Libo\ min}-t_l)\ \text{ms}.$$

* * * * *